US006357201B1

(12) United States Patent
Focke et al.

(10) Patent No.: US 6,357,201 B1
(45) Date of Patent: Mar. 19, 2002

(54) PACKAGING MACHINE, IN PARTICULAR FOR CIGARETTES

(75) Inventors: Heinz Focke; Martin Stiller, both of Verden (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/328,006

(22) Filed: Jun. 8, 1999

(30) Foreign Application Priority Data

Jun. 9, 1998 (DE) ..... 198 25 599

(51) Int. Cl.[7] ..... B65B 19/04; B65B 55/24

(52) U.S. Cl. ..... 53/167; 53/149; 53/234; 53/389.3; 131/96; 131/283; 493/373

(58) Field of Search ..... 493/373; 53/141, 53/167, 389.3, 234, 54, 149; 131/96, 283

(56) References Cited

U.S. PATENT DOCUMENTS

| | | | | | |
|---|---|---|---|---|---|
| 1,618,214 | A | * | 2/1927 | Molins | 53/149 X |
| 3,925,960 | A | * | 12/1975 | Saari | 53/167 |
| 4,396,582 | A | * | 8/1983 | Kodera | 53/167 |
| 4,454,621 | A | | 6/1984 | Testone | |
| 4,704,930 | A | | 11/1987 | Bodewein | |
| 5,049,120 | A | * | 9/1991 | Prum | 493/373 |
| 5,097,649 | A | * | 3/1992 | Ueda | 53/167 |
| 5,197,938 | A | * | 3/1993 | Chmielewski | 493/373 |
| 5,235,792 | A | * | 8/1993 | Hanagata | 53/141 |
| 5,282,527 | A | * | 2/1994 | Etani et al. | 53/149 X |
| 5,533,955 | A | * | 7/1996 | Cann | 493/373 |
| 5,671,588 | A | * | 9/1997 | Chan | 53/141 |
| 5,727,367 | A | * | 3/1998 | Cahill | 53/389.3 |
| 5,946,882 | A | * | 9/1999 | Focke | 53/141 |

FOREIGN PATENT DOCUMENTS

| | | | | |
|---|---|---|---|---|
| CH | 613 881 | | 10/1979 | |
| DE | 2752766 | A * | 6/1978 | 53/149 |
| DE | 33 03 363 | | 8/1983 | |
| DE | 41 20 973 | | 1/1993 | |
| DE | 43 21 860 | | 1/1995 | |
| DE | 295 12 151 | | 11/1995 | |
| DE | 196 30 376 | | 2/1998 | |
| EP | 16 741 | | 10/1980 | |
| EP | 360 148 | | 3/1990 | |
| EP | 633073 | | 1/1995 | |
| GB | 2618954 | | 7/1986 | |
| SE | 14358 | A * | 6/1902 | 53/167 |

* cited by examiner

*Primary Examiner*—Stephen F. Gerrity
(74) *Attorney, Agent, or Firm*—Sughrue Mion, PLLC

(57) ABSTRACT

Packaging machine, in particular for cigarettes, having sub-assemblies and elements for handling packaging material and cigarettes. In order to reduce the outlay on servicing for the packaging machine, the practice, in the region where dust and material particles occur to a pronounced extent, is for air to be extracted constantly or temporarily by suction, the particles being carried along in the process. Furthermore, particles adhering to articles, in particular to material webs, may be processed mechanically, in particular by brushes (41, 42), in order for particles to be detached and extracted by suction.

2 Claims, 17 Drawing Sheets

Figure 1:
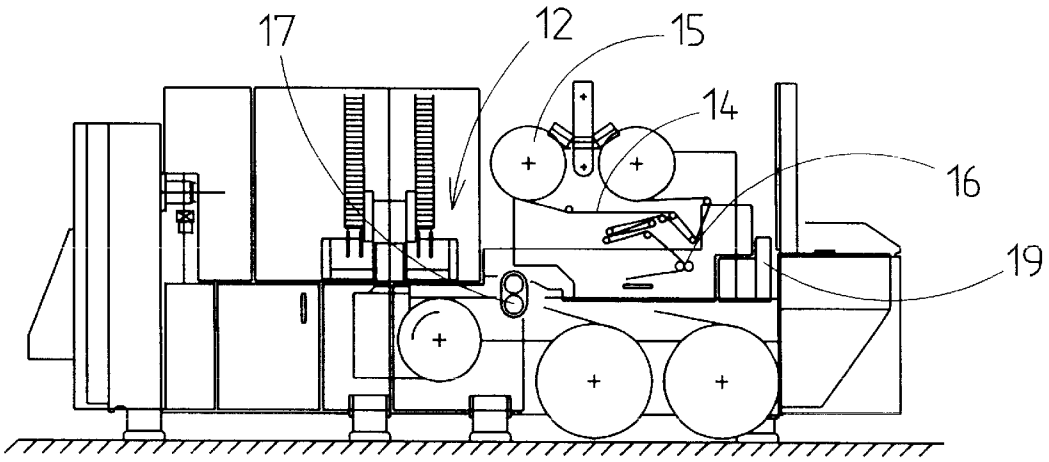

12
13
22
23
24
24
25
26
28
V
V

PACKAGING MACHINE, IN PARTICULAR FOR CIGARETTES

DESCRIPTION

The invention relates to a packaging machine, in particular for cigarettes, having subassemblies and elements for handling packaging material and cigarettes, in particular conveying elements, cutting subassemblies, folding elements, etc.

Complex packaging machines require high-outlay servicing and maintenance if the intention is to achieve the predetermined machine capacity over prolonged periods of time. In particular in the case of cigarette packaging machines with a particularly high capacity, breaks in operation for servicing or maintenance result in considerable losses.

The object of the invention is to propose measures which bring about a reduction in the servicing and maintenance outlay in the case of packaging machines, in particular those of the tobacco industry.

In order to achieve this object, the packaging machine according to the invention is characterized in that particles, material remnants, etc. of the packaging material and/or of the cigarettes are removed, in particular extracted by suction, by way of processing or handling right in the region where these particles of dirt occur to a pronounced extent.

The invention is based on the finding that constant removal of remnants and particles of dust, paper and tobacco in specific regions of the packaging machine, in particular in the region where these remnants and particles actually occur, result in a considerable reduction in stoppage times necessary for cleaning and servicing the machine. Thus, according to the invention, suction subassemblies are arranged in various positions of the packaging machine in order to extract by suction, in particular, particles of the packaging material, such as paper, paperboard, on the one hand, and in order to extract by suction tobacco particles in the region where the cigarettes are handled, on the other hand. Furthermore, the invention provides that, specifically in the region of suction-extraction subassemblies, particles are detached and extracted by suction by way of suitable action, in particular mechanical action, on material webs and electrostatic discharge of the material.

Within the context of the invention, suction subassemblies are installed, in particular, in the region of magazines for blanks, in the region of severing and punching subassemblies for severing blanks from a material web, and in the region where blanks and cigarettes are conveyed. For the purpose of treating webs made of packaging material, the invention provides a cleaning subassembly through which the material web is directed. Particles are detached and extracted by suction by way of mechanical action.

Figure 2:
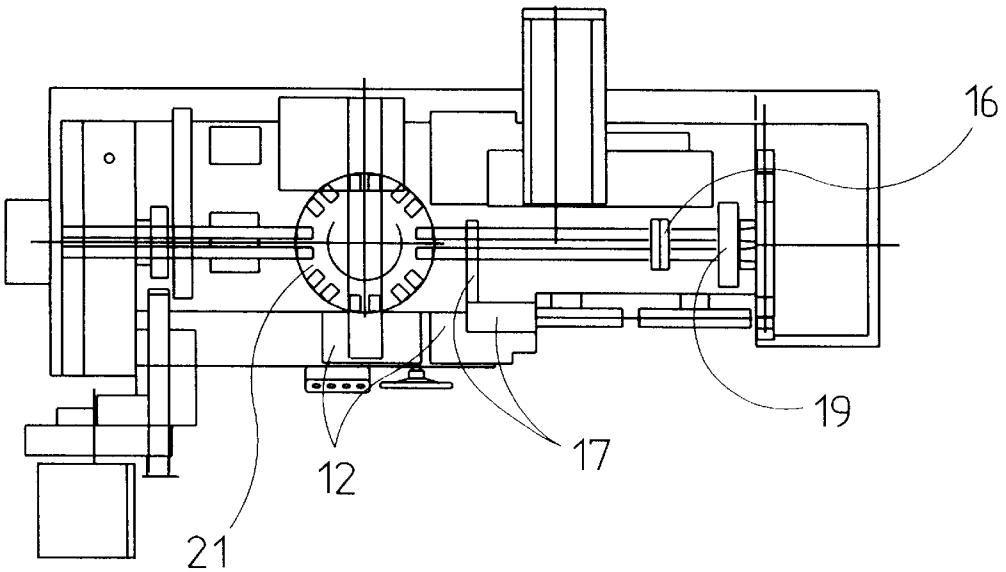
Figure 3:
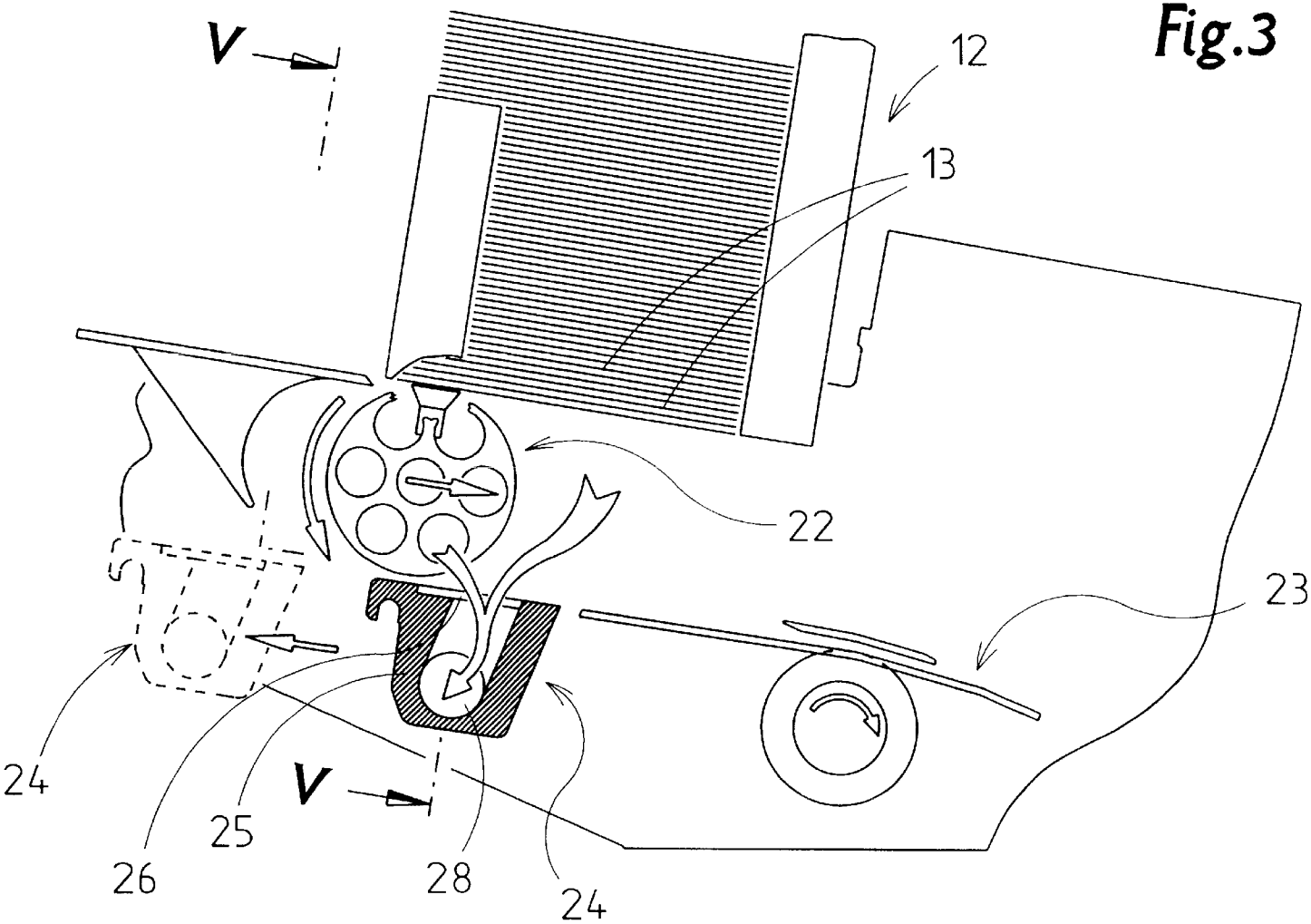
Figure 4:
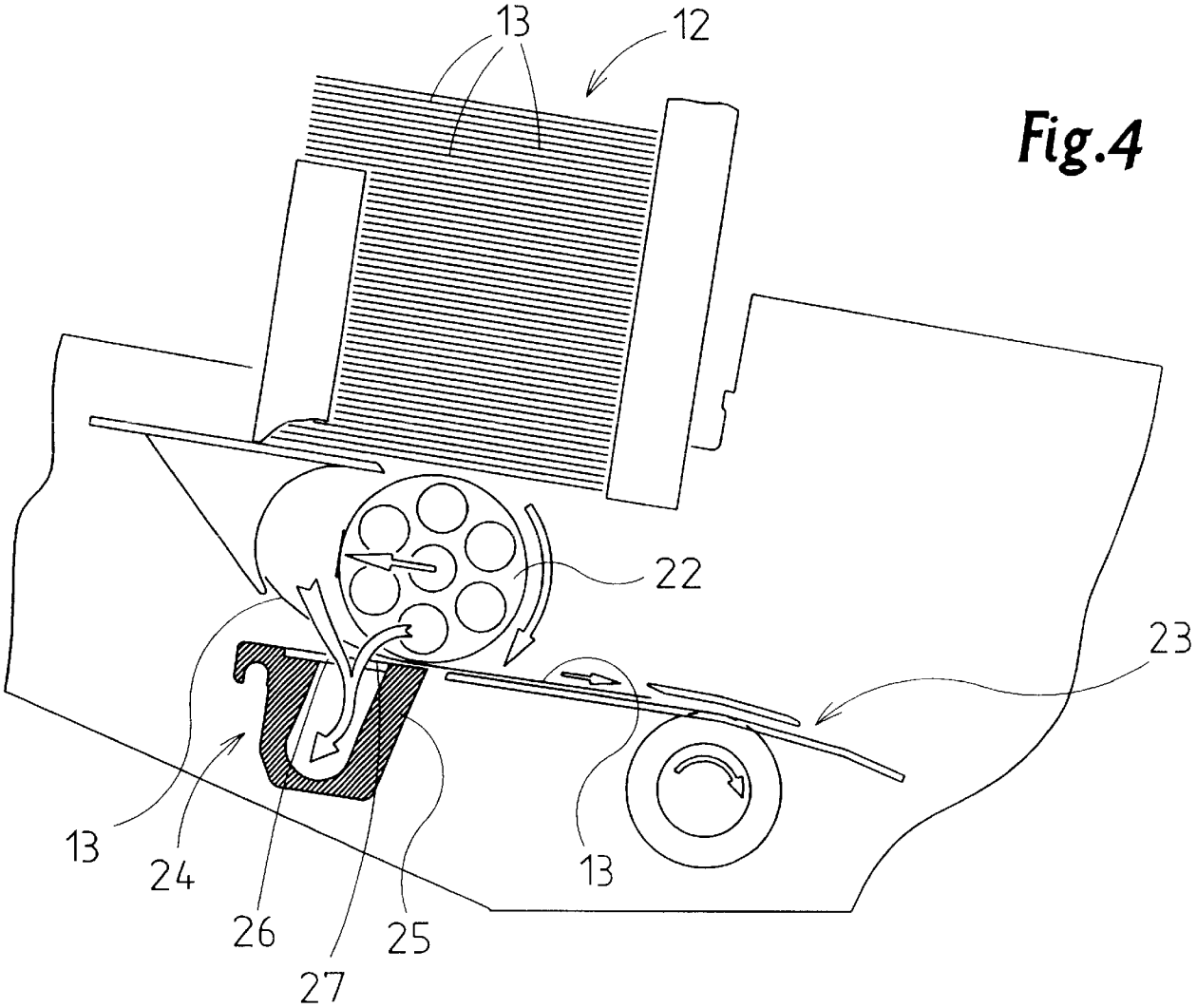
Figure 5:
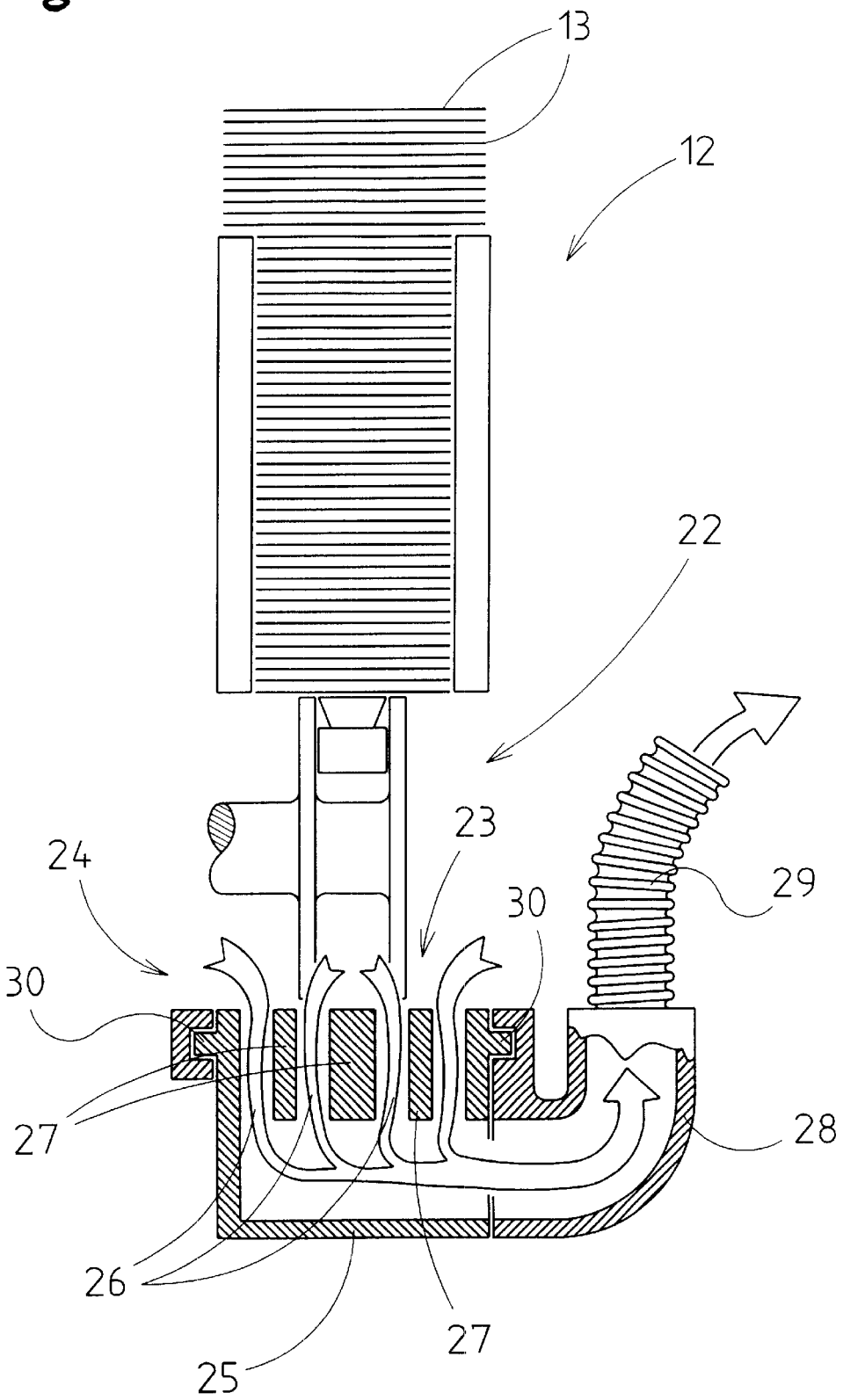
Figure 6:
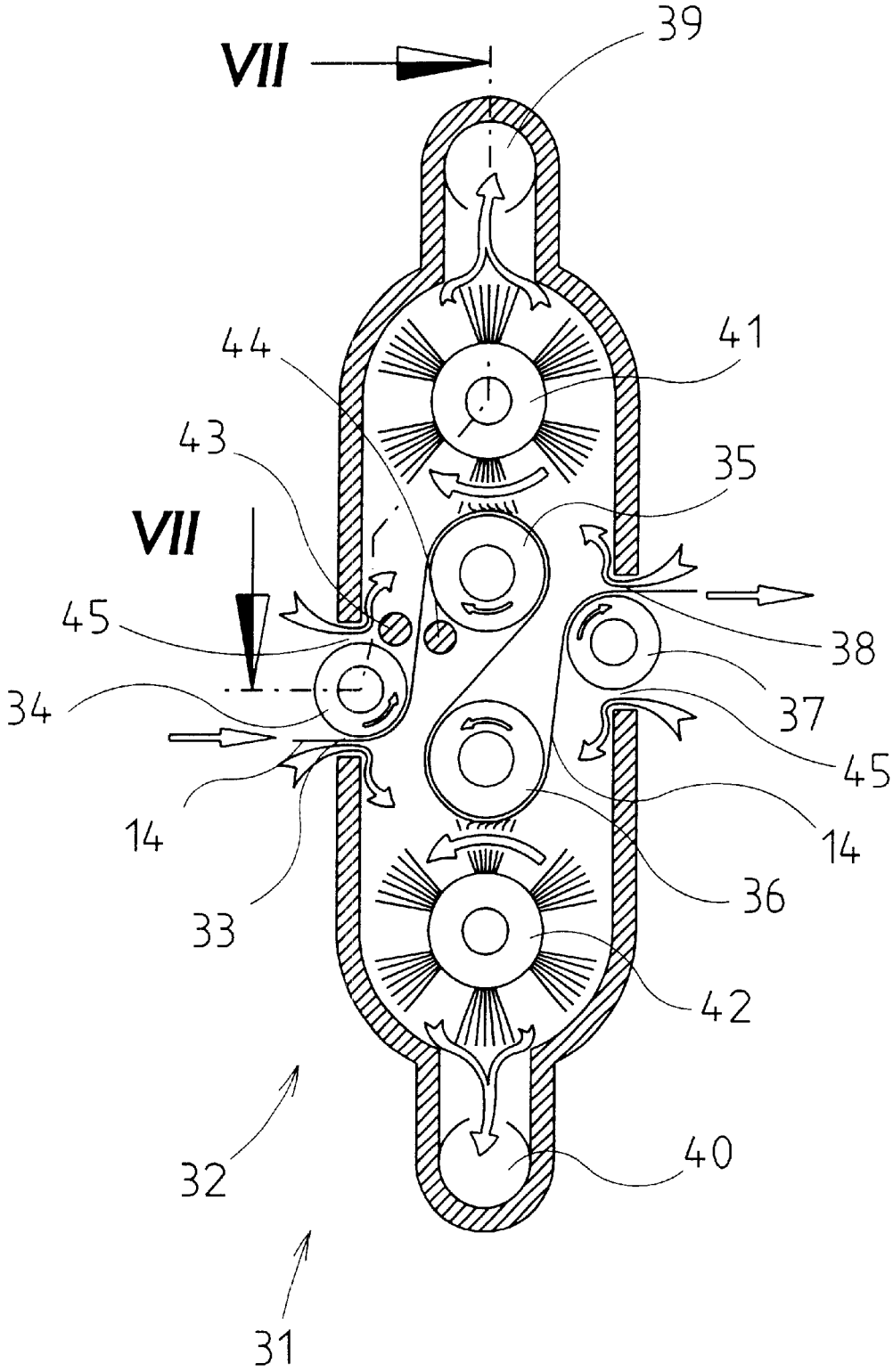
Figure 7:
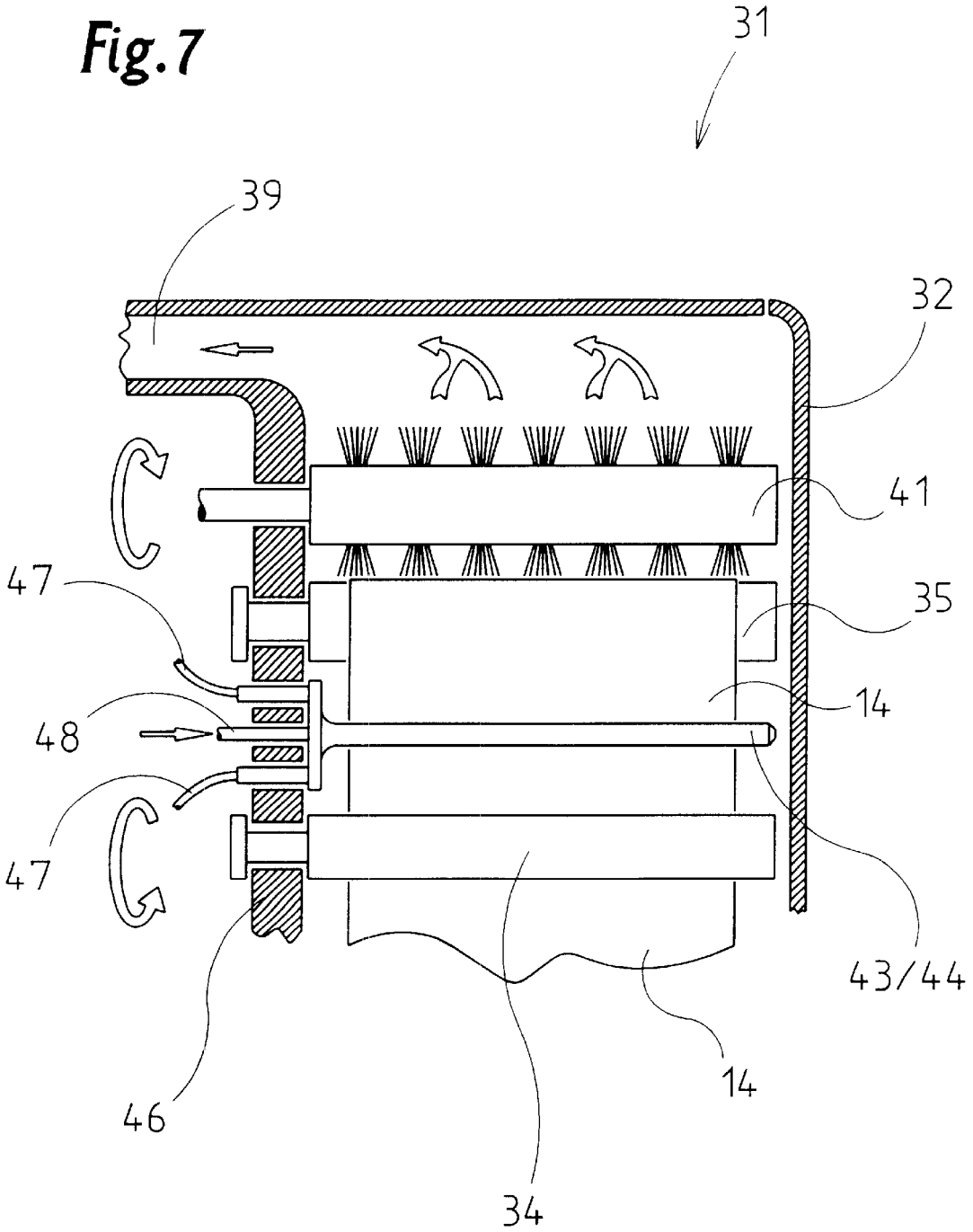
Figure 8:
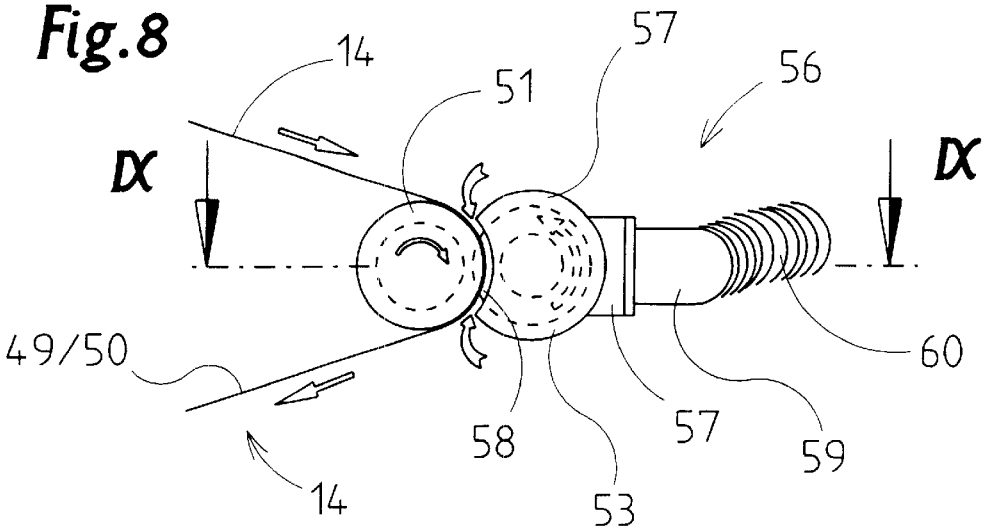
Figure 9:
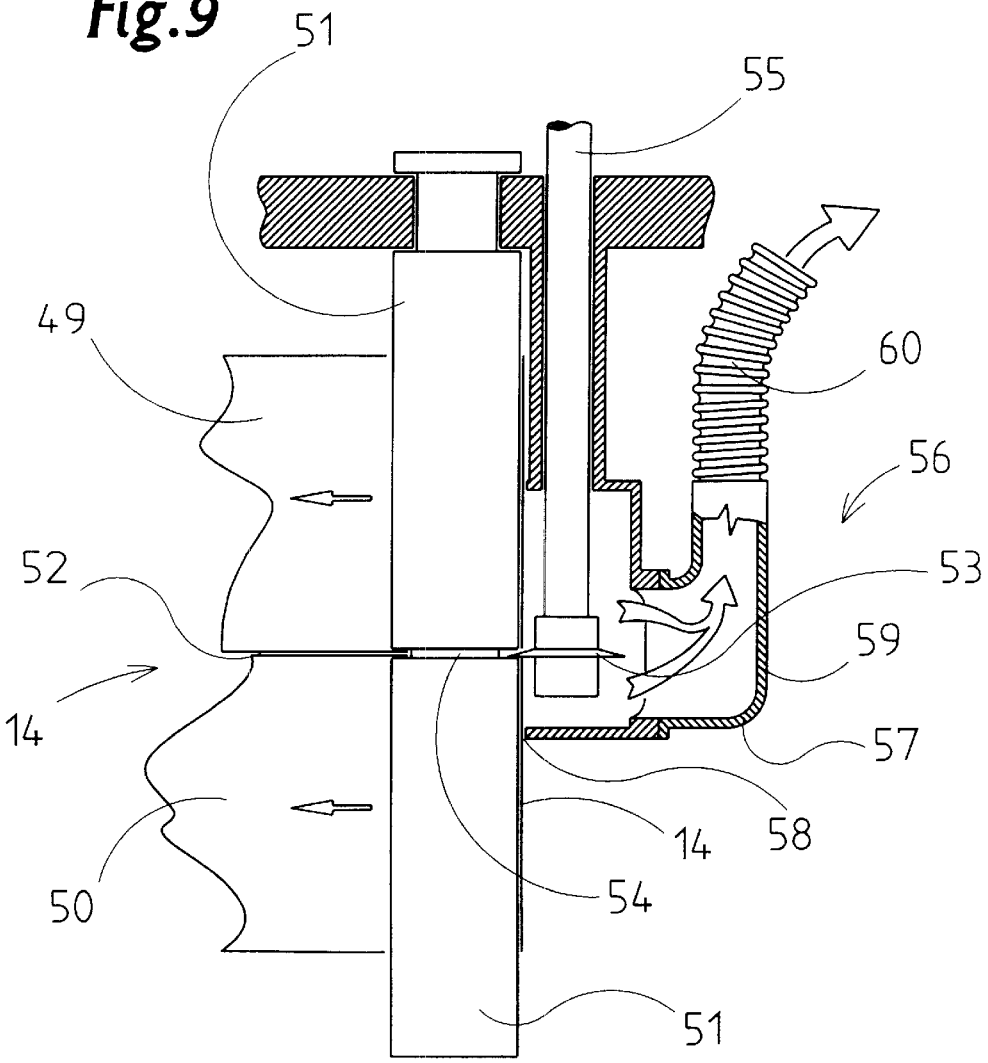
Figure 10:
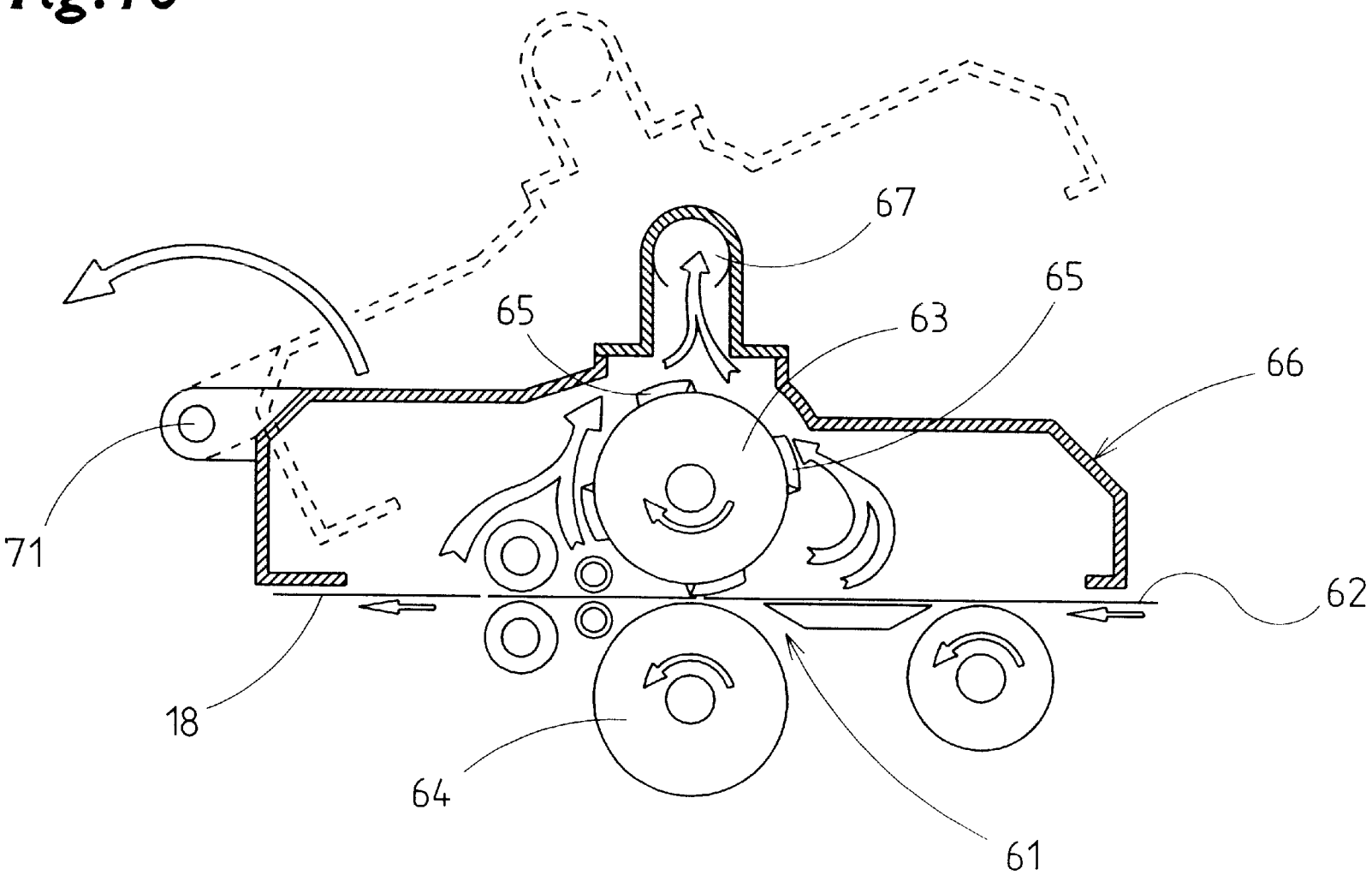
Figure 11:
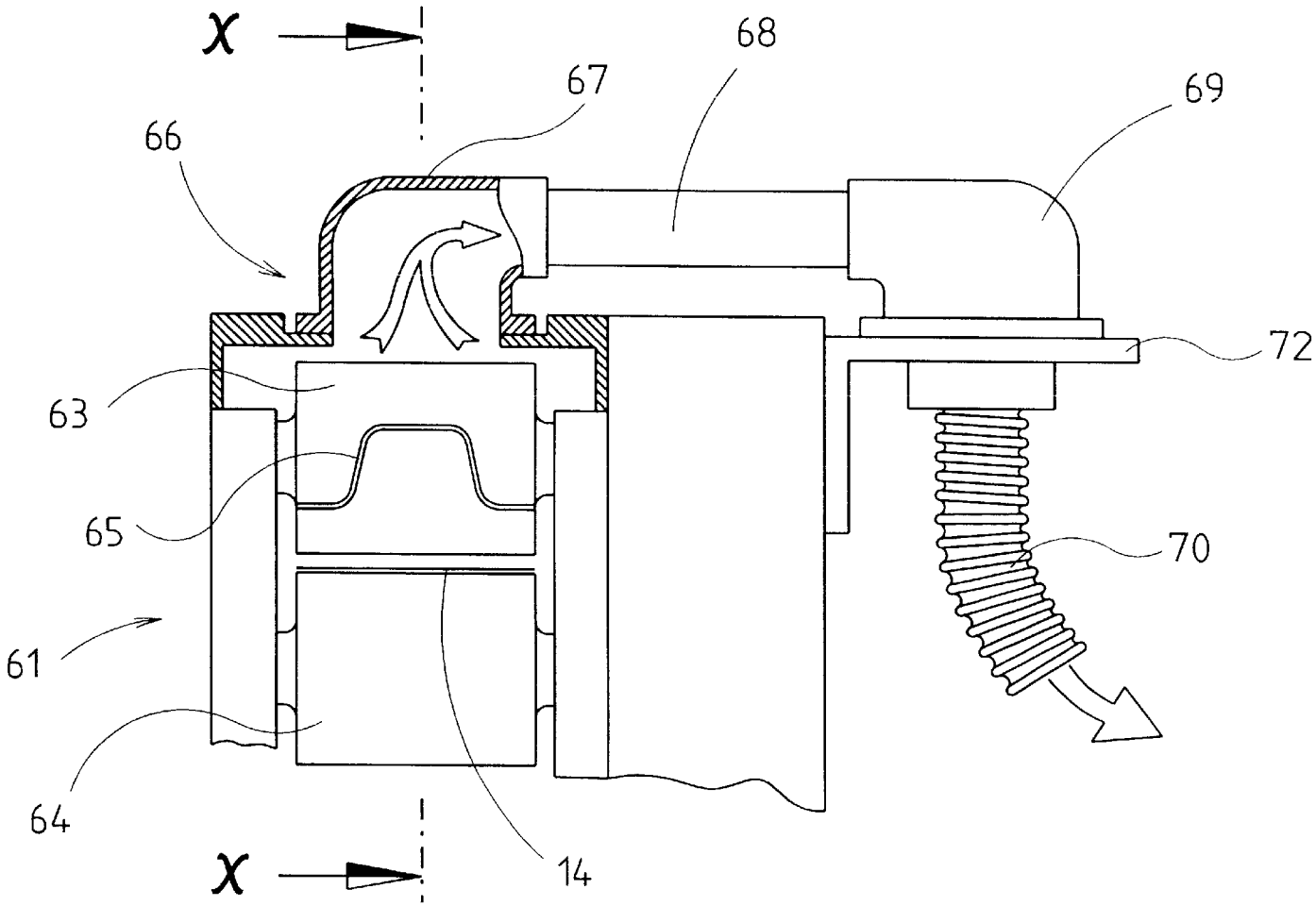
Figure 12:
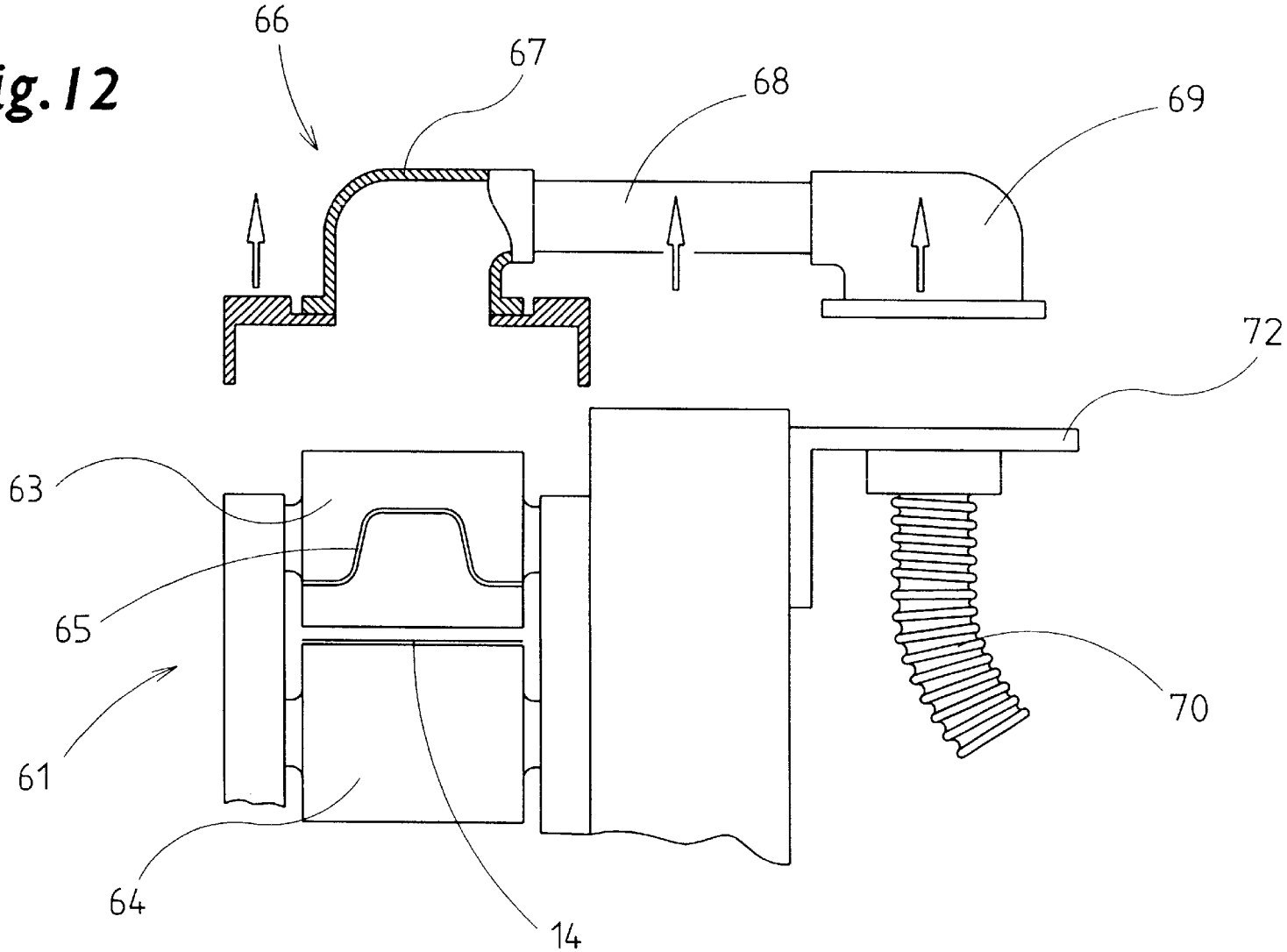
Figure 13:
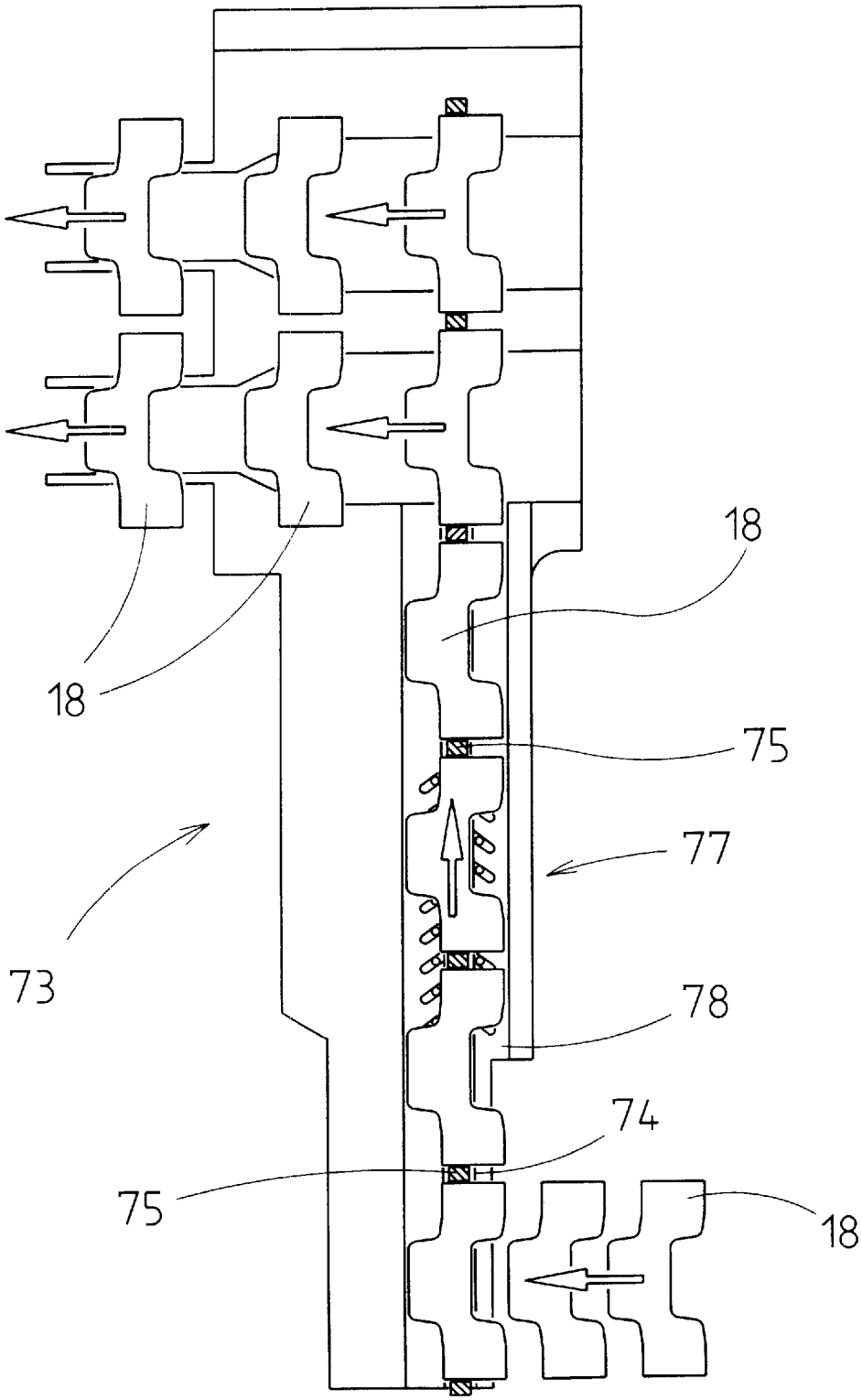
Figure 14:
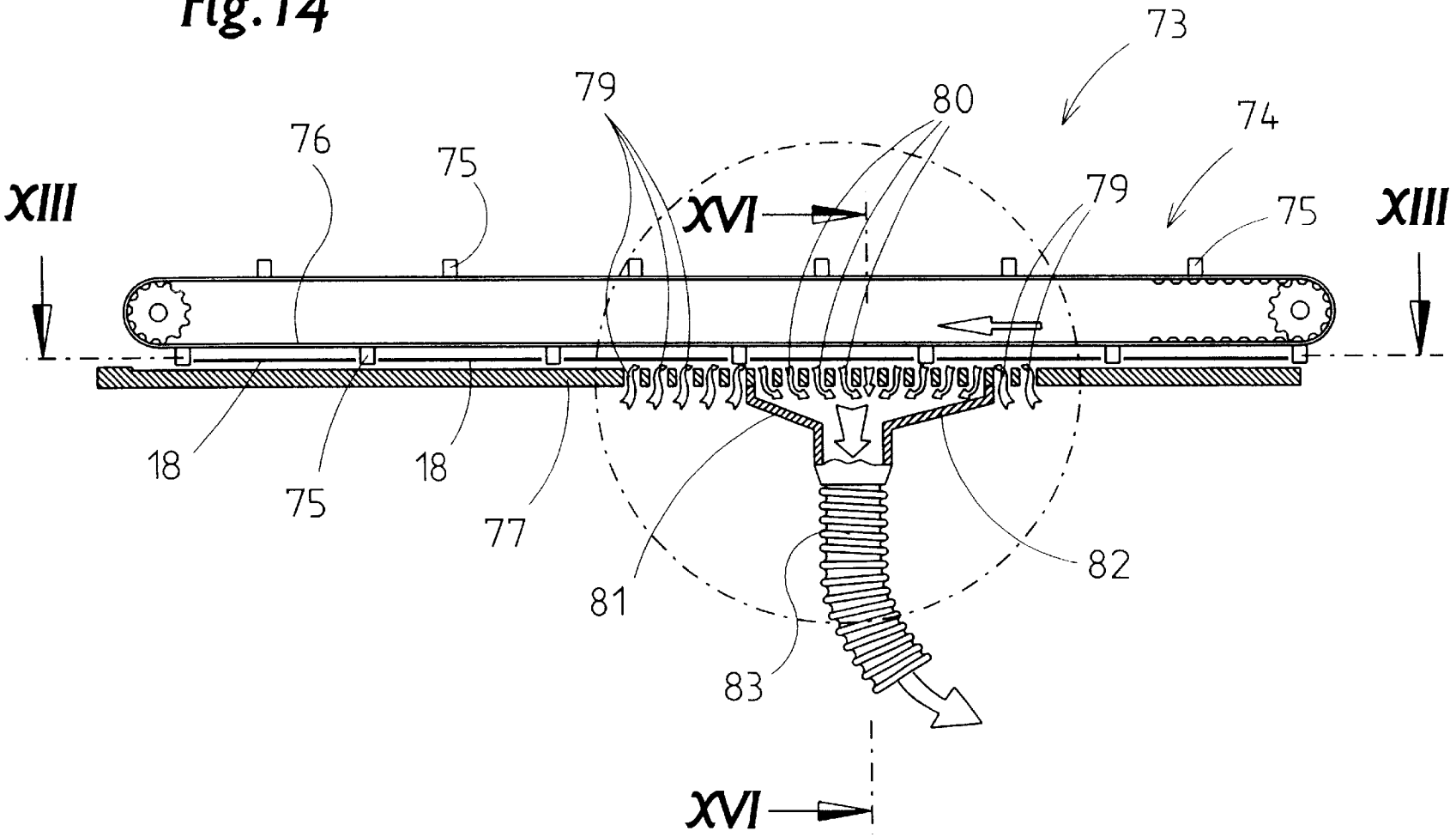
Figure 15:
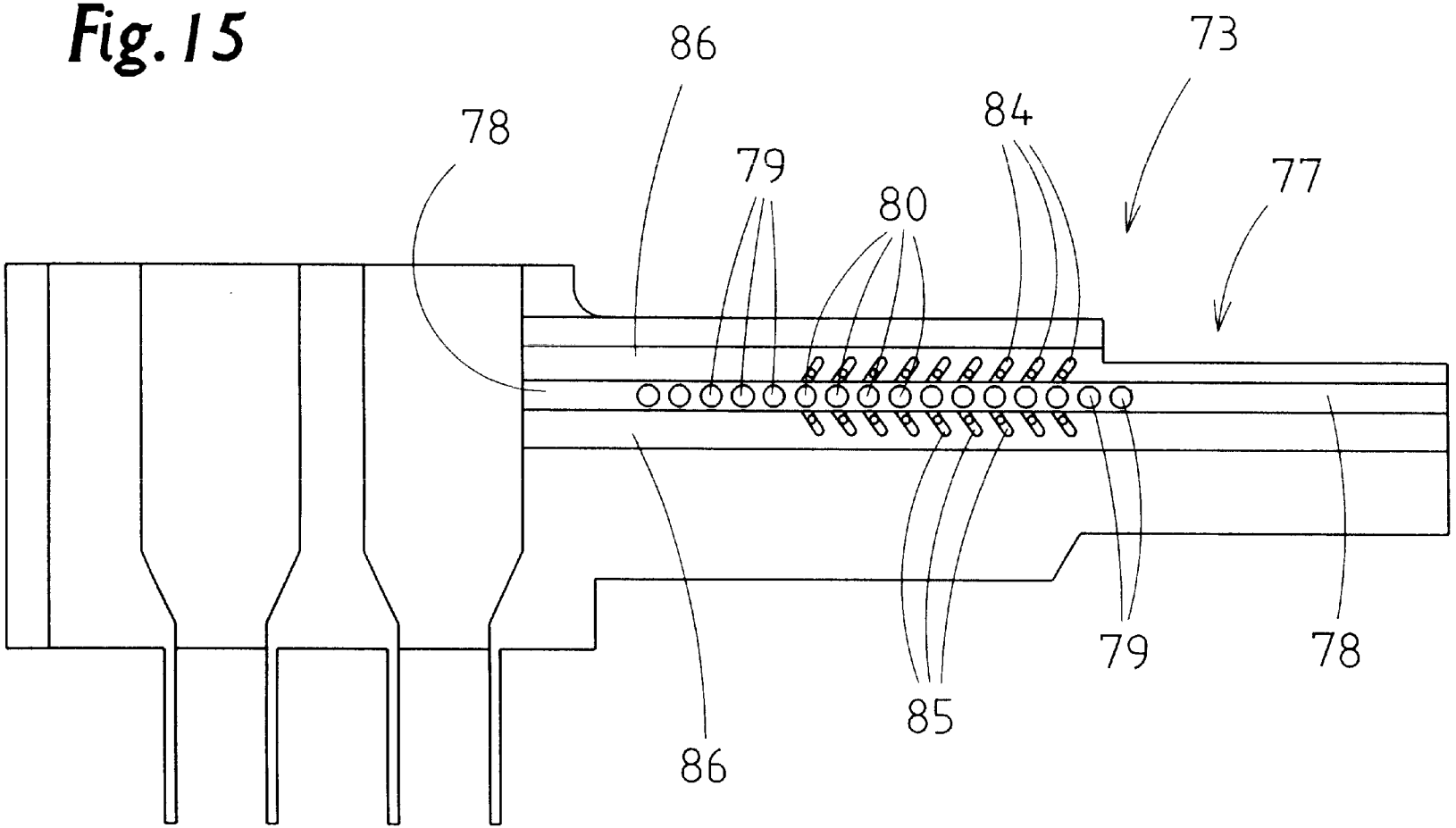
Figure 16:
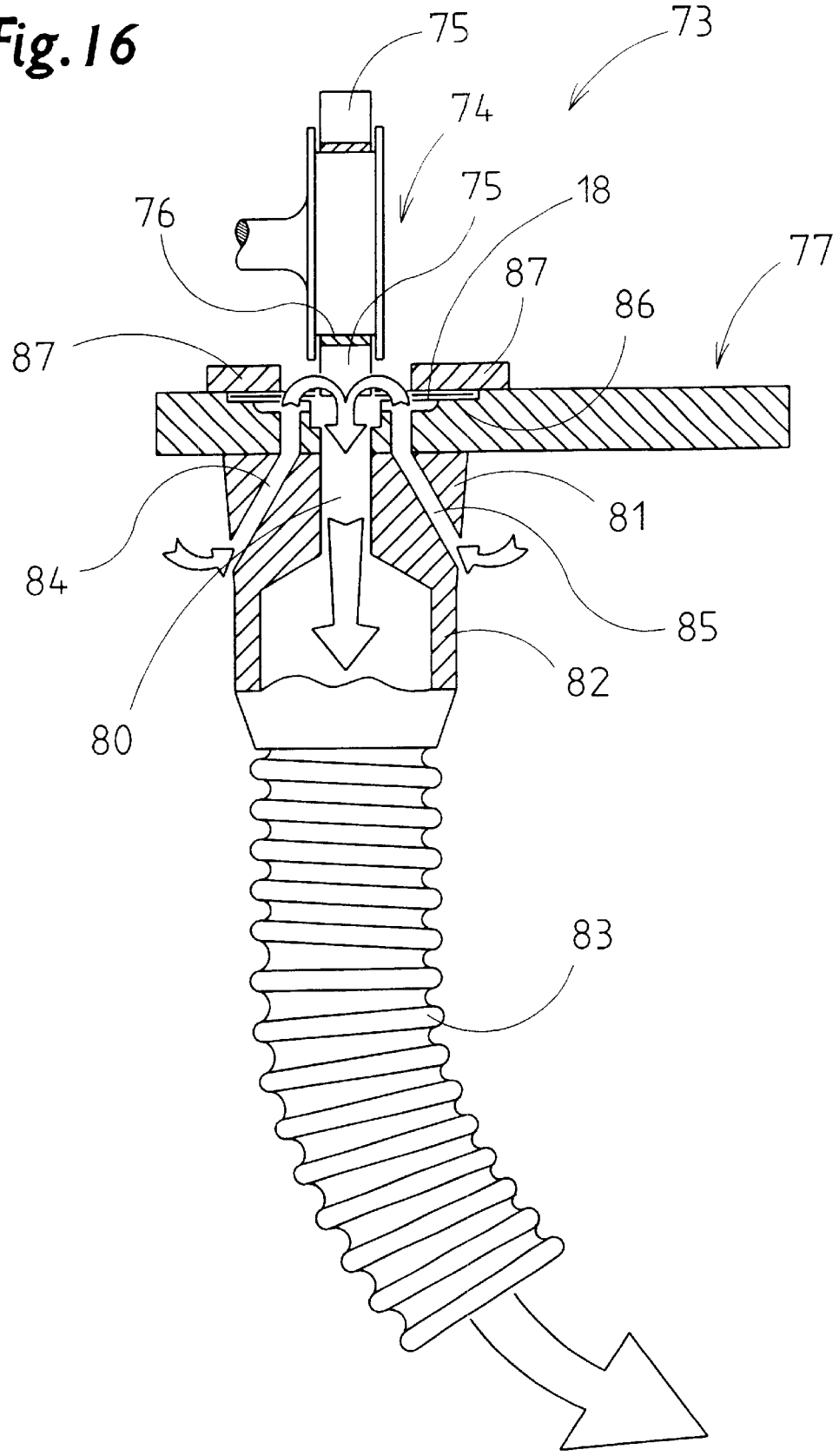
Figure 17:
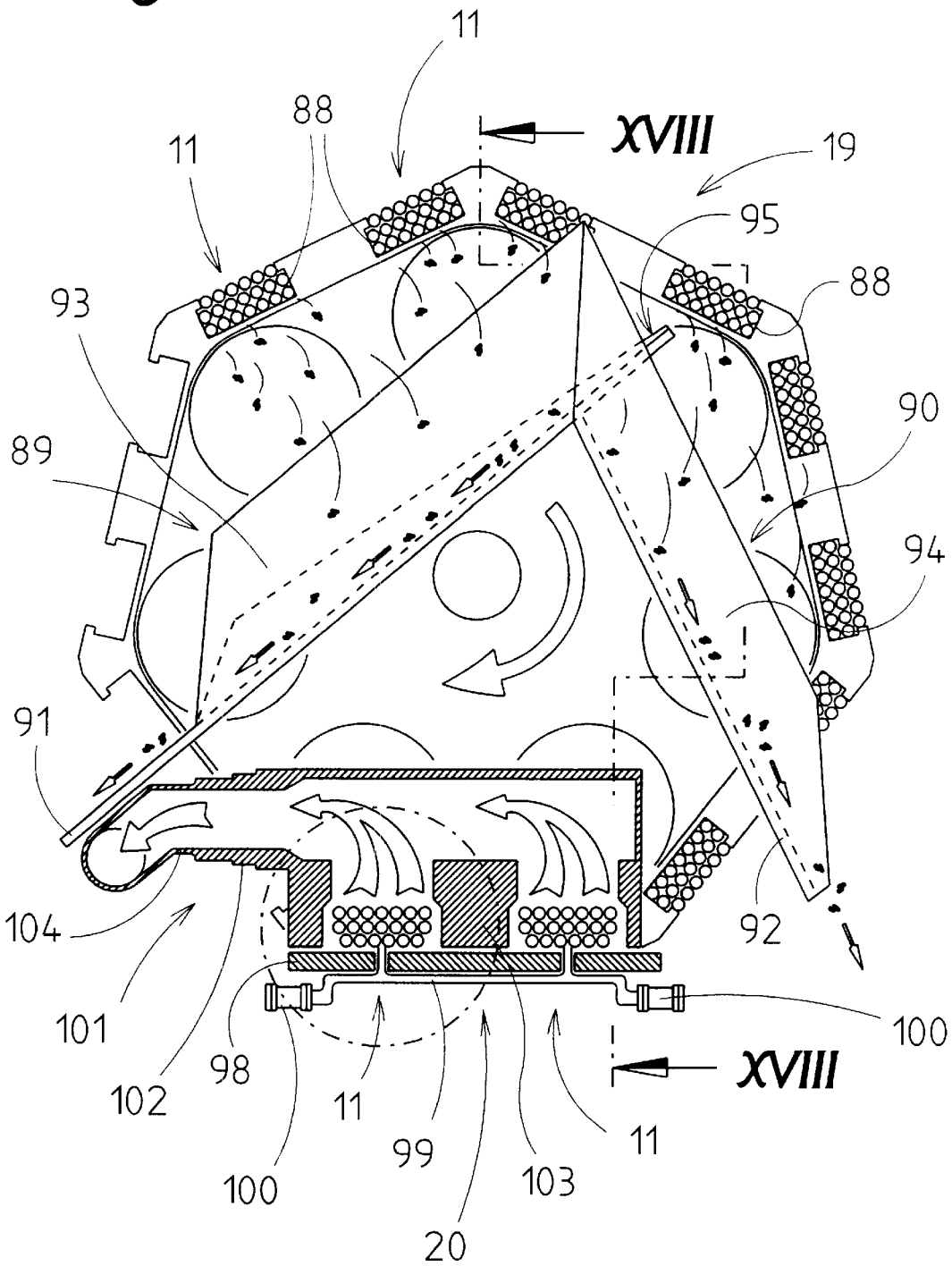
Figure 18:
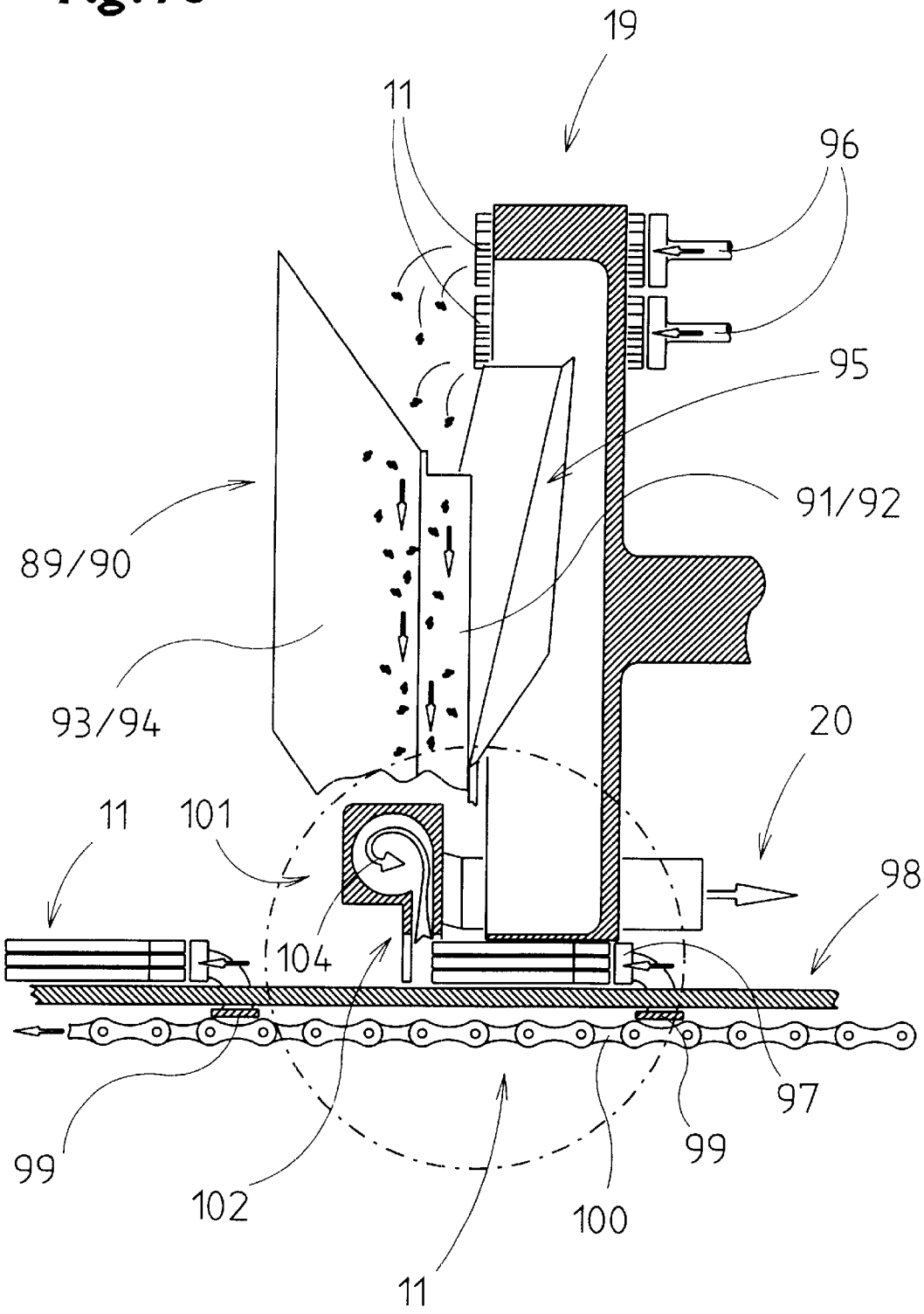
Figure 19:
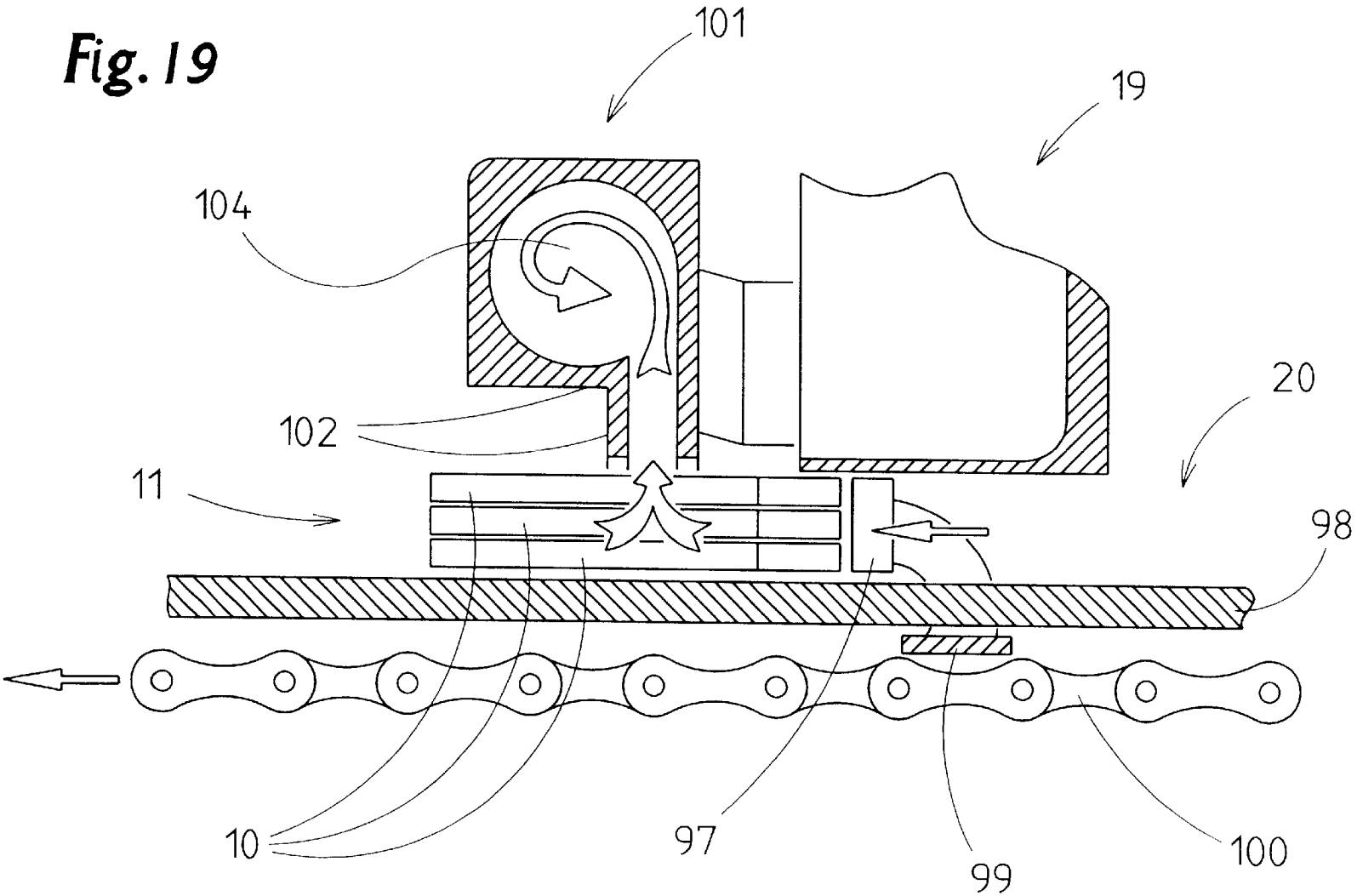

Further special features of the invention are explained in more detail hereinbelow with reference to exemplary embodiments of arrangements and the functioning thereof. In the drawings:

FIG. 1 shows a schematic side view of a packaging machine for cigarettes,

FIG. 2 shows a schematic plan view of the packaging machine according to FIG. 1, FIG. 3 shows a side view of a detail of the packaging machine, namely a blank magazine with removal elements, FIG. 4 shows the detail according to FIG. 3 in a different position, FIG. 5 shows a cross section of the arrangement along section plane V—V of FIG. 3, FIG. 6 shows a vertical section of a processing subassembly for material webs, FIG. 7 shows a partial section through the arrangement according to FIG. 6 along section plane VII—VII, FIG. 8 shows a further detail of the packaging machine, namely a cutting subassembly for severing a material web in the longitudinal direction of the latter, FIG. 9 shows a horizontal section of the arrangement according to FIG. 8 along section plane IX—IX, FIG. 10 shows a severing station for severing blanks, namely collar blanks, from a material web in a side view or along section plane X—X of FIG. 11, FIG. 11 shows a transverse view of the severing station according to FIG. 10, FIG. 12 shows an illustration analogous to FIG. 11 but with one detail in a different position, FIG. 13 shows a conveyor for blanks, namely collar blanks, in a schematic plan view or in a horizontal section XIII—XIII of FIG. 14, FIG. 14 shows the conveyor for the blanks in a side view or in longitudinal section, FIG. 15 shows a plan-view illustration analogous to FIG. 13 but without blanks, FIG. 16 shows, on an enlarged scale, a detail of the arrangement according to FIG. 14 in a vertical section along section plane XVI—XVI, FIG. 17 shows an axially directed view, partially in section, of a conveyor for cigarettes, namely a cigarette turret, FIG. 18 shows the cigarette turret in section, to be precise along plane XVIII—XVIII in FIG. 17, and FIG. 19 shows, on an enlarged scale, a detail relating to the transportation of cigarette groups, in vertical section.

The drawings show preferred exemplary embodiments in conjunction with packaging machines for cigarettes. In specific terms, the drawings illustrate subassemblies and elements of a packaging machine for hinge-lid boxes for cigarettes 10. FIGS. 1 and 2 show a side view and plan view of such a packaging machine.

The concern here is to remove dust and material particles in the region of certain subassemblies and elements for handling packaging material, on the one hand, and cigarettes 10 or cigarette groups 11, on the other hand. The handling of packaging material, on the one hand, relates to blank magazines 12, that is to say a supply of thin-cardboard blanks 13 which are produced elsewhere and are stacked one above the other. Also provided are elements for treating web-like packaging material, namely a paper web 14 (or tin-foil web) for producing blanks for an inner wrapper. The paper web 14 is drawn off continuously from a reel 15. In the present case, the paper web 14 is of double-width design and, before the blanks are produced, is severed in the longitudinal direction by a web-severing subassembly 16 to form two part-webs.

Furthermore, the invention provides a specific design for a collar subassembly 17 for producing blanks for collars 18. Collars 18 constitute a standard part of a cigarette pack of the hinge-lid-box type. The collars 18 likewise consist of thin cardboard.

As far as the handling of the pack contents, namely of the cigarettes 10, is concerned, the invention provides a specific design for a cigarette turret 19 with associated cigarette conveyor 20.

FIGS. 3, 4 and 5 show details from the region of the blank magazine 12. The latter is designed in a known manner. The individual blanks 13 are removed from the blank magazine 12 one after the other on the underside by a removal element, namely a transfer roller 22, and transferred to a blank path 23. The latter transports the blanks 13 to a location for further processing, namely to the folding turret 21. For the removal of the blanks 13, the transfer roller 22, which is a wheel-like design, executes a movement back and forth, simultaneously rotating about its own axis in the process.

A suction subassembly 24 is located beneath the blank magazine 12 or directly beneath the movement path of the transfer roller 22. Said suction subassembly comprises a housing 25 which, on the (top) side which is directed towards the blank magazine 12 or the transfer roller 22, has a plurality of slit-like suction openings 26. These extend parallel to one another and in the movement direction of the blanks 13 or of the transfer roller 22. A plurality of spaced-apart webs 27 of the housing 25 bound the slit-like suction openings 26. The blank 13 may rest on the top side of the webs 27 or be set down on the latter for further transportation (FIG. 4). The suction surface of the suction subassembly 24, which is formed by the suction openings 26, is somewhat larger than the width of the blank 13, with the result that air is sucked into the housing 25 from all sides, also from the surroundings of the transfer roller 22, the paper or cardboard particles, dust, etc. originating from the blanks 13 being carried along in the process.

The housing 25 is adjoined by a suction stub 28. Connected to the latter is a flexible suction line 29 which leads to a central suction subassembly and/or to a negative-pressure source and also to a collecting subassembly for the solid particles which have been extracted by suction.

For cleaning purposes, the housing 25 may be drawn out of the suction position via a guide 30 (dashed lines in FIG. 3), taken completely out of the machine and cleaned. In this manner clinging particles of dust can be removed by relatively little additional work or servicing.

FIGS. 6 and 7 show the construction and the functioning of a cleaning subassembly 31 for continuous material webs, in particular for the paper web 14. The cleaning subassembly 31 is installed at a suitable location in the conveying path of the (double-width) paper web 14. The paper web 14 is directed through the cleaning subassembly 31 in a continuous manner.

The cleaning subassembly 31 comprises an elongate, upright housing 32. the material web or paper web 14 passes into the housing 32 via an inlet opening 33, which is formed approximately halfway up, and is deflected in the upward direction by a first deflecting roller 34. Two further deflecting rollers 35 and 36 are arranged one above the other within the housing 32. The paper web 14 is guided around the two deflecting rollers 35, 36 in the form of an S and, with a further deflection by way of a further deflecting roller 37, passes horizontally out of the housing 32 via an outlet opening 38.

Dust and other particles which are supplied by the paper web 14 are extracted by suction within the housing 32. In each case one suction stub 39, 40 adjoins the top and bottom regions of the housing 32. The extraction by suction is active over the entire width of the paper web 14. The suction stubs 39, 40 are led away in the lateral direction (FIG. 7) and connected to a negative-pressure source.

The suction-extraction operation is assisted by additional processing, to be precise mechanical processing, of the paper web 14 in order to detach adhering particles. For this purpose, rotating brushes 41, 42 are mounted in the top and bottom regions of the housing 32. Said brushes extend transversely to the paper web 14 in the region of a deflection of the latter. In the present case, the brushes 41, 42 are positioned above and beneath the deflecting rollers 35, 36. The brushes 41, 42 are driven in rotation counter to the movement direction of the paper web 14, with the result that radially projecting bristles process the surface in opposite directions. By virtue of the abovedescribed deflection of the paper web 14, the brushes 41, 42 process both sides of said paper web by way of a brushing-off movement. The detached particles are also extracted by suction.

The air which has been extracted by suction is directed into the housing 32 via gap-like air openings 45. The air openings 45 are formed in the region of the inlet opening 33, on the one hand, and of the outlet opening 38, on the other hand, adjacent to the deflecting rollers 34, 37.

In addition, the paper web 14 is treated by way of electrostatic discharge. For this purpose, ion spray nozzles 43, 44 of known design are arranged, within the housing 32, on both sides of the paper web 14. The ion spray nozzles 43, 44 extend transversely to the movement direction of the paper web 14, on both sides of the latter, with the result that the paper web 14 is subjected to the action of ionized air on both sides. The ion spray nozzles 43, 44 act such that ionized air is directed onto the web by blowers, that is to say by compressed air. The ion spray nozzles 43, 44 make it possible for particles which are fixed on the material web or paper web 14 on account of electrostatic charge to be easily detached. The ion spray nozzles thus act upstream of the mechanical tools, that is to say upstream of the brushes 41, 42, as seen in the conveying direction of the paper web 14. The ion spray nozzles 43, 44 are mounted on one side in a load-bearing wall 46 with electrical connections 47 and compressed-air connections 48. The deflecting rollers 34..37 and the brushes 41, 42 are also mounted in the load-bearing wall 46 as elements which project on one side.

FIGS. 8 and 9 show a subassembly for processing a continuous material web, in the present case the paper web 14. The latter is of double-width design and, before blanks are produced, is severed in the longitudinal direction in the region of a web-severing subassembly 16, this resulting in two individual webs 49, 50. For this purpose, the material web or paper web 14 is directed over a deflecting roller 51 which is mounted such that it projects on one side. In the region of said roller, a continuous severing cut 52 is executed by a wheel-like or disc-like severing cutter 53. For this purpose, the severing cutter 53 passes into a groove. 54 which runs in the circumferential direction of the deflecting roller 51. The severing cutter 53 is driven in rotation by a shaft 55.

Since material particles, that is to say in particular paper particles, occur to a pronounced extent in the region of the severing cut by way of the severing cutter 53, the web-severing subassembly 16 is assigned a suction element 56. The suction element 56 comprises a housing 57 which encloses the web-severing region, that is to say the region of the severing cutter 53 in particular. The housing 57 fits closely against the cylindrical contour of the deflecting roller 51. Air passes into the housing 57 via gaps 58 during the suction-extraction operation. The shaft 55 leads into the housing 57. A suction stub 59 adjoining the housing 57 serves for the connection of an elastic suction line 60.

FIGS. 10 to 16 deal with the collar subassembly 17. The details shown in FIGS. 10, 11 and 12 relate to a cutting subassembly 61 for severing the blanks for the collar 18 from a continuous material web 62 made of thin cardboard. The cutting subassembly 61 essentially comprises cutting elements, namely a cutter roller 63 and a mating roller 64. Projecting cutting edges 65 are arranged on the cutter roller in accordance with the contour of the collars 18 which are to be severed from the material web 62.

The cutting subassembly 61 is provided with a suction subassembly. For this purpose, a hood-like covering, namely a suction bell 66, is located in the region of the cutter roller 63, and is arranged above the material web 62. The suction bell 66 is open at the bottom, or on the side which is directed towards the material web 62, with the result that air can pass in. The suction bell 66 is adjoined by at least one suction stub 67 which passes into the suction bell 66 centrally on the top side. The suction stub 67 is connected to a connecting stub 69 via a transversely directed or horizontal suction tube 68. Said connecting stub is adjoined by an elastic suction line 70.

Suction air is led away via the suction bell 66, dust and paper particles being carried along in the process.

A special feature is that the suction bell 66 can be raised up. In the case of the example shown, an eccentric pivot bearing 71 is formed on one side. The suction bell 66 can be pivoted upwards about said pivot bearing 71 (dashed lines in FIG. 10). The suction stub 67, suction tube 68 and connecting stub 69 can be raised therewith (FIG. 12). In this case, the connecting stub 69 is raised up from a fixed supporting profile 72, to which the suction line 70 is connected. In the operating position (FIG. 11), the connecting stub 69 butts against the supporting profile 72 in a sealing manner.

It is also the case that once the collars 18 have been severed from the material web 62, it is intended to remove further dust and material particles occurring, in particular, during the transportation of the collars 18. According to FIG. 13, the collars 18 are transported along a path with a transverse conveying path 73. In the region of the latter, the collars 18 are carried along by an endless conveyor, namely by a conveying belt 74 designed as a toothed belt. The latter has a plurality of carry-along elements 75. A bottom strand of the conveying belt 74 serves as conveying strand 76. The carry-along elements 75, which are directed downwards in the region of said conveying strands, each grip a collar 18 at a side border of the same. The collars 18 are transported in a sliding manner on a conveying plate 77.

A suction-extraction element is arranged at least in a sub-region of the transverse conveying path 73. In the case of the present exemplary embodiment, the conveying plate 77 is permeable to air in a sub-region, with the result that air can be extracted by suction in the downward direction, particles being carried along in the process.

As can be seen, in particular, from FIG. 14, the conveying plate 77 is provided in a central region, to be precise in the region of a longitudinally extending groove-like depression or longitudinal groove 78, with a row of suction bores 79, 80. A number of these suction bores 79, which are positioned in a row, serves for supplying from the outside or from beneath, in accordance with the illustration with reference to arrows in FIG. 14, air which is to be extracted by suction. The other, central suction bores 80 serve for extracting air by suction. For this purpose, in the region of these suction bores 80, a suction covering 81 of funnel-like configuration is provided on the underside of the conveying plate 77. An elastic suction line 83 is connected to the suction covering 81 via a stub 82, with the result that particle-containing air can be extracted by suction from this region.

In order to improve the suction action, further air-supply means to the conveying region of the collars 18 are provided. These are air channels 84, 85 which are arranged in the conveying plate 77 laterally alongside the longitudinal groove 78 and are provided exclusively in the region of the suction bores 80 for suction-extraction purposes. The air channels 84, 85 are located in the movement path of lateral parts of the collars 18 (FIG. 13). Air is supplied in the upward direction from beneath, that is to say from a region beneath the conveying plate 77, and is then extracted by suction with other air via the suction bores 80.

In order to ensure a reliable conveying movement of the collars 18 despite the intensive air flow, the conveying plate 77 has a flat depression 86 in accordance with the transverse dimension of the collars 18. The collars 18 are conveyed in this depression 86. On the top side, top guides 87 are provided on both sides. The collars 18 are conveyed in a preferably continuous manner and supplied to the packs or the folding turret 21 by way of a double path.

FIGS. 17, 18 and 19 relate to examples for removing solid particles in the region where cigarettes 10 or cigarette groups 11 are handled.

FIG. 17 shows a view of a conveyor for cigarettes 10, namely for cigarette groups 11 which are appropriate for packs. Said conveyor is a cigarette turret 19 which is of polygonal design and, in the region of a rectilinear cross-sectional contour, has in each case two spaced-apart pockets 88, each for receiving a cigarette group. The cigarette turret 19 is driven in a rotatable manner. The (two) pockets 88 located in the bottom region in each case are emptied by virtue of the (two) cigarette groups 11 being pushed out in the longitudinal direction of the cigarettes.

In the region of the conveyor, namely of the cigarette turret 19, tobacco particles occur to a pronounced extent. These are specifically intercepted and conveyed away. In the case of the present exemplary embodiment, the cigarette turret 19 is assigned a system of chutes, namely, on the one hand, two conveying chutes 89 and 90 arranged at an acute angle with respect to one another. Particles which have been intercepted or received are directed downwards, under their own weight, by said chutes. Beneath the ends of the conveying chutes 89, 90, the tobacco is intercepted in suitable containers and expediently supplied to the production process of the cigarettes 10 again.

The conveying chutes 89, 90 are positioned in the form of a V, offset in the axial direction in relation to the cigarette turret 19, and dimensioned such that particles from all the pockets 88 of the cigarette turret 19 can be intercepted. On the side which is directed towards the cigarette turret 19, the conveying chutes 89, 90 each form a chute base 91, 92. In the top region, these are connected to one another or butt against one another in the form of a roof. On the side which is directed away from the cigarette turret 19, obliquely directed, that is to say funnel-like side walls 93, 94 are provided on the chute bases 91, 92. This means that even particles which drop down randomly are received in a reliable manner.

Also provided is an inner chute 95 which extends into the cigarette turret 19, designed as a pot-like hollow body, and leads outwards in the downward direction, adjoining the conveying chute 89. This means that particles which are intercepted in the interior of the cigarette turret 19 are also caught, collected and led away. The inner chute 95 is designed in a manner analogous to the conveying chutes 89, 90. As can be seen from FIG. 18, the cigarette groups 11 are pushed in pairs into the pockets 88, by pushers 96, in the top region of the cigarette turret 19, on the opposite side from the chute system.

The cigarette groups 11 are pushed out of the pockets 88 of the cigarette turret 19 by an endless conveyor. For this purpose, carry-along elements 97 pass into the associated pockets 88 from the rear side and push the cigarette groups 11 out of the pockets 88 on account of the (continuous) conveying movement. The cigarette groups 11 are conveyed further (in pairs) on a cigarette path 98.

The pushers 97 are connected to lateral endless conveyors, namely to conveying chains 100, via connecting rods 99. Said conveying chains are driven in an appropriate manner.

In the region where the cigarette groups 11 are transferred to the cigarette path 98 and, if appropriate, in the further-conveying region, tobacco and other particles are likewise removed, to be precise by being extracted by suction. A suction-extraction unit 101 is located right in the region of the cigarette turret 19, namely in the region where the cigarette groups 11 are pushed out of the pockets 88. Said unit comprises a hood-like housing 102 which encloses a region of the cigarette path 98 from above. In the present case, the housing 102 has a central partition wall 103 between the two simultaneously conveyed cigarette groups 11 (FIG. 17). From chambers formed in this way, which are open at the bottom and top, air—with particles—is extracted by suction in accordance with the arrows illustrated. For this purpose, the housing 102 is adjoined laterally by a suction stub 104. The latter, in turn, is connected to a (flexible) suction line which leads to a negative-pressure source.

Correspondingly designed suction-extraction units may be positioned on the rest of the conveying path of the cigarette groups 11.

What is claimed is:

1. A packaging machine for production of cigarette packs, wherein cigarette groups (11), respectively corresponding to contents of the cigarette packs, are transported through a cigarette turret (19) which has respective pockets (88) for the cigarette groups, and wherein the cigarette groups (11) are pushed out of the respective pockets (88), and then transported by a cigarette conveyor (20), said machine comprising:

a) means for rotatably mounting the cigarette turret (19) in a vertical plane;

b) located immediately adjacent to the cigarette turret (19), two conveying chutes (89, 90) which are directed downward in an oblique plane from an upper region of the cigarette turret; and c) means for positioning the two conveying chutes (89, 90) at an angle to one another to form an inverted V, in such a manner that captured particles are directed downwards under their own weight, d) wherein the conveying chutes (89, 90) have a configuration which causes tobacco particles to be directed to either side of the cigarette conveyor (20) which follows the cigarette turret (19).

2. The machine according to claim 1, further comprising, located within the cigarette turret (19) which is configured as a hollow-body open at one side, an inner chute (95) for catching particles appearing within the cigarette turret (19) and conveying them to an exterior conveying chute (89).

* * * * *